US010781675B2

(12) United States Patent
Von Kaenel et al.

(10) Patent No.: US 10,781,675 B2
(45) Date of Patent: Sep. 22, 2020

(54) CHARGE TUBE WITH SELF-LOCKING ALIGNMENT FIXTURES

(71) Applicant: HALLIBURTON ENERGY SERVICES, INC., Houston, TX (US)

(72) Inventors: Scott Randall Von Kaenel, Fort Worth, TX (US); William Martin Kamp, Burleson, TX (US); Austin Ward, Burleson, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/503,669

(22) PCT Filed: Sep. 10, 2014

(86) PCT No.: PCT/US2014/054881
§ 371 (c)(1),
(2) Date: Feb. 13, 2017

(87) PCT Pub. No.: WO2016/039735
PCT Pub. Date: Mar. 17, 2016

(65) Prior Publication Data
US 2017/0268317 A1 Sep. 21, 2017

(51) Int. Cl.
*E21B 43/116* (2006.01)

(52) U.S. Cl.
CPC ..... *E21B 43/116* (2013.01)

(58) Field of Classification Search
CPC ..... E21B 43/11; E21B 43/116; E21B 43/117; E21B 43/118
USPC ..... 89/1.15, 1.151; 175/4.6
See application file for complete search history.

(56) References Cited

U.S. PATENT DOCUMENTS 3,471,177 A 10/1969 Garrett et al.
4,193,460 A * 3/1980 Gilbert ..... E21B 43/117 102/293
8,336,437 B2 12/2012 Barlow et al.
(Continued)

FOREIGN PATENT DOCUMENTS

WO 2008144243 A1 11/2008

OTHER PUBLICATIONS

International Search Report and Written Opinion; PCT Application No. PCT/US2014/054881; dated Jun. 1, 2015.

*Primary Examiner* — John Cooper
(74) *Attorney, Agent, or Firm* — Polsinelli PC

(57) ABSTRACT

Systems and methods used in perforation tool assemblies and more particularly charge tubes and self-locking alignment fixtures. The perforation tool assembly comprises an alignment fixture having a plurality of slots and a charge tube having a plurality of protrusions on an end of the charge tube that engage the plurality of slots on the alignment fixture. The perforation tool assembly can also include an alignment finger on an outer edge of the alignment fixture that aligns the charge tube radially with respect to a gun body. The alignment fixture can be formed of steel or a powdered metal. The slots on the alignment fixture can be formed by water-jet cutting, machining, molding, or casting. A plurality of charges can be disposed within the charge tube once assembled. The alignment finger on the alignment fixture can engage a milled slot on an interior surface of the gun body.

16 Claims, 6 Drawing Sheets

(56) References Cited

U.S. PATENT DOCUMENTS

| | | | | |
|---|---|---|---|---|
| 2003/0047358 | A1* | 3/2003 | Bonkowski | E21B 43/119 175/4.6 |
| 2004/0216866 | A1* | 11/2004 | Barlow | E21B 43/119 166/55 |
| 2005/0016728 | A1 | 1/2005 | Sloan et al. | |
| 2007/0084336 | A1* | 4/2007 | Neves | E21B 43/119 89/1.3 |
| 2014/0076631 | A1 | 3/2014 | Rodgers et al. | |
| 2015/0337635 | A1* | 11/2015 | Langford | E21B 43/116 89/1.15 |

* cited by examiner

CHARGE TUBE WITH SELF-LOCKING ALIGNMENT FIXTURES

CROSS-REFERENCE TO RELATED APPLICATIONS

This application is a national stage entry of PCT/US2014/054881 filed Sep. 10, 2014, said application is expressly incorporated herein in its entirety.

FIELD

The present technology pertains to systems and methods used in perforation tool assemblies, and more specifically pertains to charge tubes and self-locking alignment fixtures.

BACKGROUND

Wellbores are drilled into the earth for a variety of purposes including tapping into hydrocarbon bearing formations to extract the hydrocarbons for use as fuel, lubricants, chemical production, and other purposes. When a wellbore has been completed, a metal tubular casing may be placed and cemented in the wellbore. Thereafter, a perforation tool assembly may be run into the casing, and one or more perforation guns in the perforation tool assembly may be activated and/or fired to perforate the casing and/or the formation to promote production of hydrocarbons from selected formations. Perforation guns may comprise one or more explosive charges that may be selectively activated, the detonation of the explosive charges desirably piercing the casing and penetrating at least partly into the formation proximate to the wellbore.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed systems may be implemented using any number of techniques. The disclosure should in no way be limited to the illustrative implementations, drawings, and techniques illustrated herein, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and also may include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "radial" and/or "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics described in more detail below, will be readily apparent to those skilled in the art with the aid of this disclosure upon reading the following detailed description, and by referring to the accompanying drawings.

Figure 1:
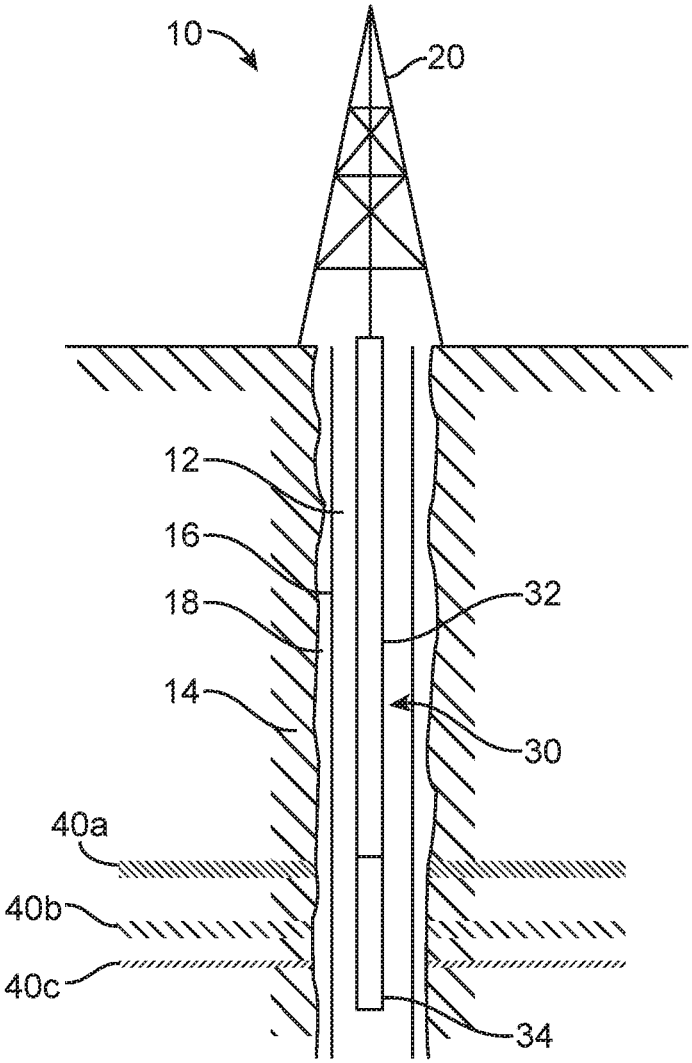
FIG. 1 is a diagram of a wellbore and workstring according to an embodiment of the disclosure.

Reference is now made to FIG. 1 showing a wellbore servicing system 10. The system 10 comprises servicing rig 20 that extends over and around a wellbore 12 that penetrates a subterranean formation 14 for the purpose of recovering hydrocarbons from a first production zone 40*a*, a second production zone 40*b*, and/or a third production zone 40*c*, collectively the "production zones 40". The wellbore 12 may be drilled into the subterranean formation 14 using any suitable drilling technique. While shown as extending vertically from the surface in FIG. 1, the wellbore 12 may also be deviated, horizontal, and/or curved over at least some portions of the wellbore 12. For example, the wellbore 12, or a lateral wellbore drilled off of the wellbore 12, may deviate and remain within one of the production zones 40. The wellbore 12 may be cased, open hole, contain tubing, and may generally comprise a hole in the ground having a variety of shapes and/or geometries as is known to those of skill in the art. In this illustrated embodiment, a casing 16 may be placed in the wellbore 12 and secured at least in part by cement 18.

The servicing rig 20 may be one of a drilling rig, a completion rig, a workover rig, or other mast structure and supports a workstring 30 in a wellbore 12, but a different structure may also support the workstring 30. The servicing rig 20 may also comprise a derrick with a rig floor through which the workstring 30 extends downward from the servicing rig 20 into the wellbore 12. In other environments, such as in an off-shore location, the servicing rig 20 may be supported by piers extending downwards to a seabed. Alternatively, in some examples, the servicing rig 20 may be supported by columns sitting on hulls and/or pontoons that are ballasted below the water surface, which may be referred to as a semi-submersible platform or rig. In an off-shore location, a casing 16 may extend from the servicing rig 20 to exclude sea water and contain drilling fluid returns. It is understood that other mechanical mechanisms, not shown, may control the run-in and withdrawal of the workstring 30 in the wellbore 12, for example a draw works coupled to a hoisting apparatus, a slickline unit or a wireline unit including a winching apparatus, another servicing vehicle, a coiled tubing unit, and/or other apparatus.

The workstring 30 may comprise a conveyance 32 and a perforation tool assembly 34, such as a perforation gun assembly for example. The conveyance 32 may be any of a string of jointed pipes, a slickline, a coiled tubing, and a wireline. The workstring 30 may further comprise one or more downhole tools (not shown in FIG. 1), for example the perforation tool assembly 34. The workstring 30 may comprise one or more packers, one or more completion components such as screens and/or production valves, sensing and/or measuring equipment, and other equipment which are not shown in FIG. 1. In some contexts, the workstring 30 may be lowered into the wellbore 12 to position the perforation tool assembly 34 to perforate the casing 16 and penetrate one or more of the production zones 40.

Figure 2:
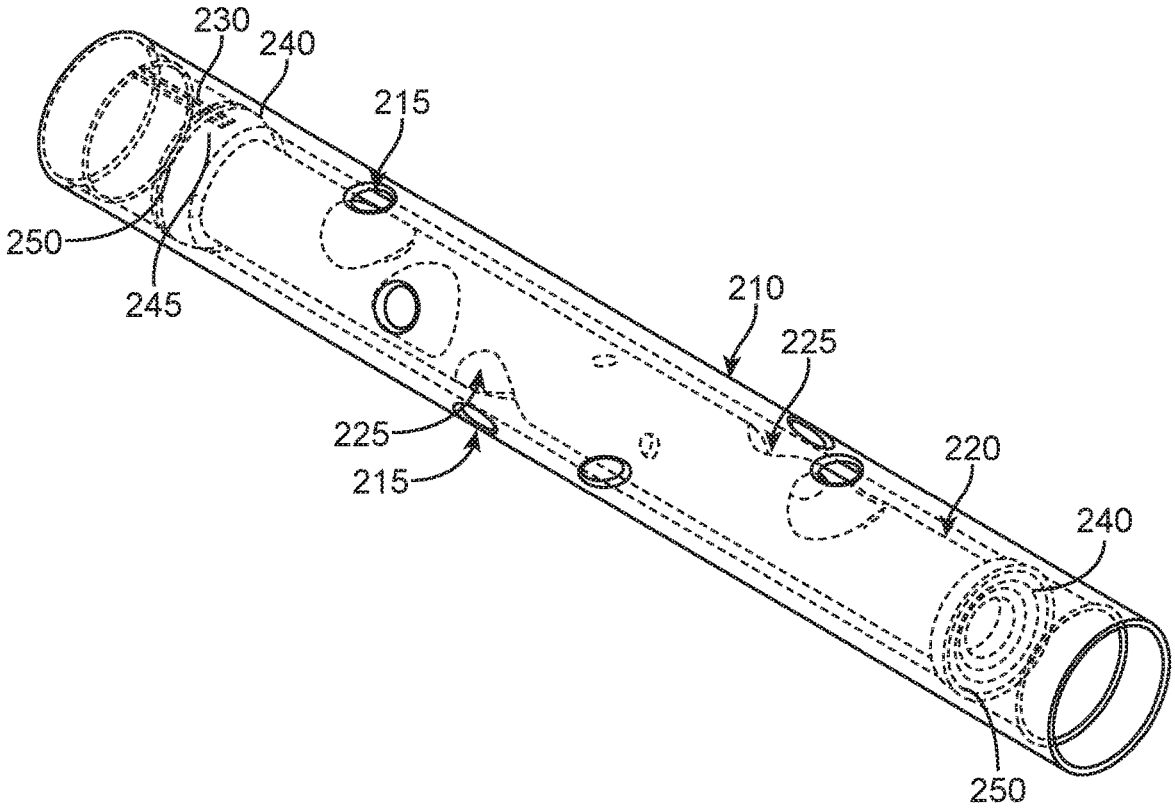
FIG. 2 is a diagram of a partially-assembled gun body with a charge tube and alignment fixture received in the gun body according to an embodiment of the disclosure.

Reference is now made to FIG. 2 which is a diagram of a partially-assembled gun body with a charge tube and alignment fixture received in the gun body according to an embodiment of the disclosure. A gun body 210, as part of an overall perforation gun assembly, for example the assembly 34 shown in FIG. 1, has a plurality of recesses or "scallops" 215 on an exterior surface of the gun body 210. The scallops 215 provide a path for the charge material to more easily blast through after detonation of the charges. The gun body 210 is for receiving a charge tube 220. The charge tube 220 has a plurality of openings 225 for receiving charges (not shown in FIG. 2). A "charge" generally has a steel outer casing that contains an explosive powder or similar material that is activated and pierces through the scallops 215 of the gun body 210. An alignment fixture 240 is secured to each end of the charge tube 220 and includes an alignment finger 245 that engages with a slot 230 on an interior surface of the gun body 210. A snap ring 250 can be implemented to secure the charge tube 220 and attached alignment fixture 240 within the gun body 210. The snap ring 250 can be designed to compress along the interior surface of the gun body 210 during insertion and then snap into an appropriate groove in the gun body once inserted within the gun body. The alignment finger 245 integrated on the alignment fixture 240 allows for tool-less (i.e. without any tools) installation of the charge tube and alignment fixture at the appropriate location with respect to the scallops of the gun body. The alignment finger 245 replaces any need for a set screw to secure the alignment fixture 240, and thereby the charge tube 220, into place in the gun body 210.

Figure 3:
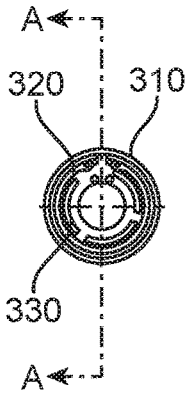
FIG. 3 is a diagram of an alignment fixture secured to a charge tube and inserted in a gun body, as viewed from the end of the gun body, according to an embodiment.
Figure 4:
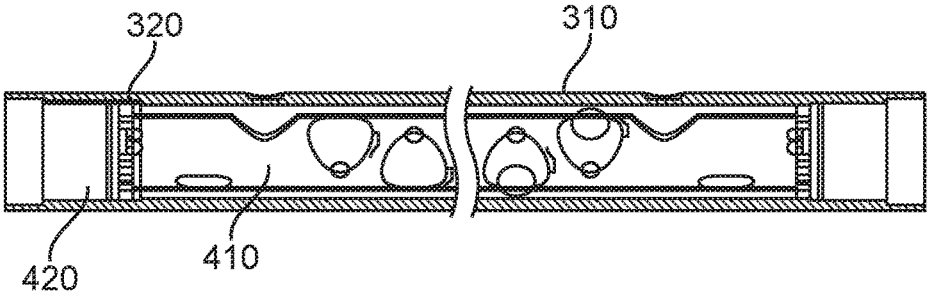
FIG. 4 is a diagram of an alignment fixture secured to a charge tube, as viewed in cross-section along line A-A of FIG. 3, according to an embodiment of the disclosure.

Reference is now made to FIGS. 3 and 4 showing a diagram of an alignment fixture secured to a charge tube and inserted in a gun body, as viewed, respectively, from the end of the gun body and in cross-section, according to an embodiment. FIG. 4 shows the cross-section as taken along line A-A of FIG. 3. The gun body 310 has an alignment fixture 320 placed therein. The alignment fixture 320 is secured to the charge tube by charge tube protrusions 330 that engage openings in the alignment fixture 320, as shown in greater detail in FIGS. 6-9. With reference to FIG. 4, the charge tube 410 has an alignment fixture 320 secured on each end. A gunconnector 420 can be provided as a connector between the various gun bodies within an overall perforating tool assembly.

Figure 5:
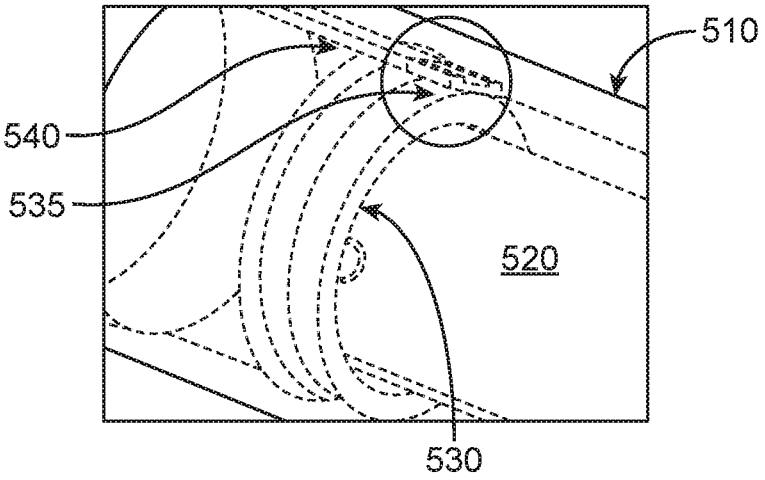
FIG. 5 is a diagram of an alignment fixture with integrated alignment finger engaging an interior surface of the gun body, according to an embodiment of the disclosure.

FIG. 5 is a diagram of an alignment fixture with integrated alignment finger on the alignment fixture engaging an interior surface of the gun body to properly align the charge tube 520 with respect to scallops (for example scallops 215 in FIG. 2, not shown in FIG. 5) on exterior surface of the gun body 510. The gun body 510 has a charge tube 520 received therein. The charge tube 520 has an alignment fixture 530 secured thereto. The alignment fixture 530 has at least one alignment finger 535 integrated thereon that engages with at least one slot 540 on an interior surface of the gun body 510 to properly align the charge tube 520 (and thereby the charges, not shown, but contained in the charge tube) with the proper scallops on the exterior surface of the gun body 510. See, for example, scallops 215 in the embodiment of FIG. 2. Although a single alignment finger is illustrates as engaging a single slot on the gun body, multiple alignment fingers can engage multiple slots as should be apparent to those having ordinary skill in the art.

Figure 6:
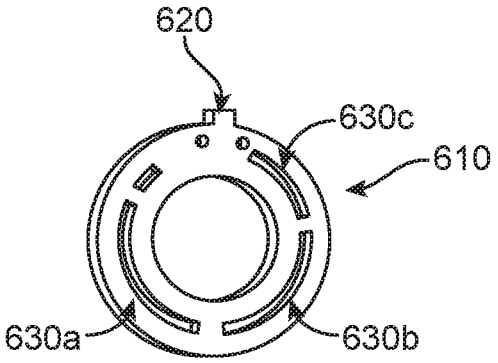
FIG. 6 is a diagram of an alignment fixture having a plurality of openings and an integrated alignment finger, as viewed from an end of the alignment fixture, according to an embodiment of the disclosure.

FIG. 6 is a diagram of an alignment fixture having a plurality of openings and an integrated alignment finger, as viewed from an end of the alignment fixture. The alignment fixture is connected to and aligns the charge tube with respect to the gun body in which the charge tube and alignment fixture are received. The alignment fixture 610 has an alignment finger 620 integrated thereon that is adapted to engage a milled slot on the interior surface of the gun body. The alignment fixture 610 includes a plurality of openings (collectively "630"), including a first opening

630*a*, a second opening 630*b* and a third opening 630*c*. Although depicted as slots, it should be clear to those ordinarily skilled in the art that any appropriate opening, hole or through structure capable of engaging the charge tube, can be implemented.

Figure 7:
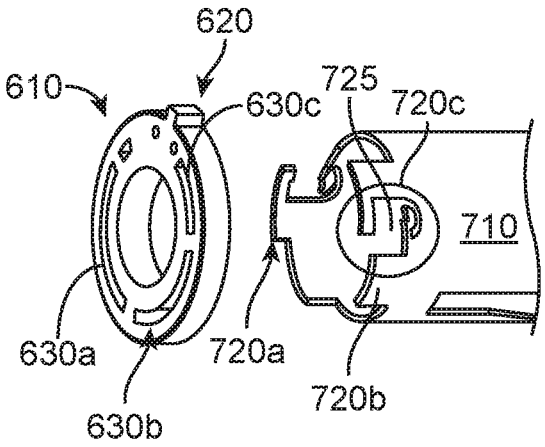
FIG. 7 is a diagram of the alignment fixture having a plurality of openings that are adapted to releasably engage a plurality of protrusions on a charge tube, as viewed from the side, according to an embodiment of the disclosure.

Reference is now made to FIG. 7 which is a diagram of the alignment fixture 610 having a plurality of openings adapted to releasably engage a plurality of protrusions on a charge tube 710, as viewed from the side. The alignment fixture 610 includes the alignment fmger 620 and the openings or slots 630*a*, 630*b* and 630*c*. Each slot 630 receives a protrusion on a charge tube for securing the alignment fixture 610 to the charge tube 710. The charge tube 710 has a plurality of protrusions (collectively "720"), including a first protrusion 720*a* that engages with the first opening 630*a*, a second protrusion 720*b* that engages with the second opening 630*b*, and a third protrusion 720*c* that engages with the third opening 630*c*.

Figure 8:
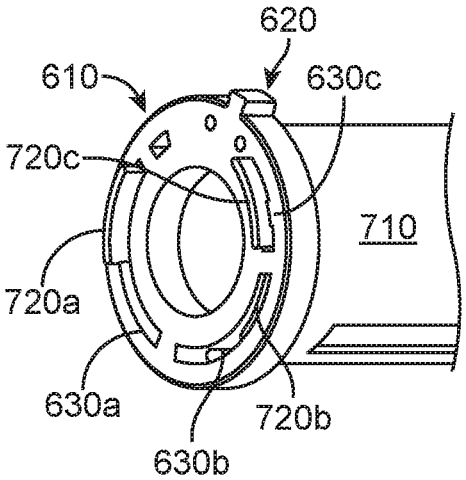
FIG. 8 is a diagram of an alignment fixture engaged with a charge tube and having been rotated into a first "connected" state, according to an embodiment of the disclosure.

To centralize the charge tube 710 on each end, the alignment fixtures 610 have an outer diameter that is approximately equivalent to the drift diameter of the gun body, or approximately 0.015-inches to 0.05-inches under the minimal gun inner diameter and is variable depending upon the size of the charge tube and the gun body in which it is received, as well as the particular application in which the perforation tool assembly is being used. Using the alignment fixture 610 having slots 630 that engage the protrusions 720 on the charge tube 710, there is no longer any screws to secure the alignment fixture to the charge tube. Moreover, the alignment fixture locks onto the charge tube without the use of any tools (i.e., tool-lessly) and self-locks onto the tube. Once aligned and inserted (as shown in FIG. 8), the alignment fixture is turned counter-clockwise to lock it onto the charge tube (see arrow 910 in FIG. 9). The locking action is obtained by the protrusions on the charge tube locking onto the alignment fixture. If or when desired, the alignment fixture can be turned clockwise (in a direction opposite to arrow 910) to unlock the alignment fixture from the charge tube. This eliminates any screws from the gun assembly and improves assembly and dis-assembly time. It should be apparent to those of ordinary skill that the alignment finger and charge tube can be formed to lock when turned clockwise and unlock when turned counter-clockwise. The alignment fixtures can be formed of a powdered metal, such as steel or aluminum, or a plastic material or a rubber material, but other materials within ordinary skill can be employed. The alignment fixtures can be cut or otherwise manufactured using typical manufacturing methods such as machining, molding, and casting, as well as cutting with a water jet. This alignment fixture desirably maintains the centralization of the charge tube within the gun body.

Figure 11:
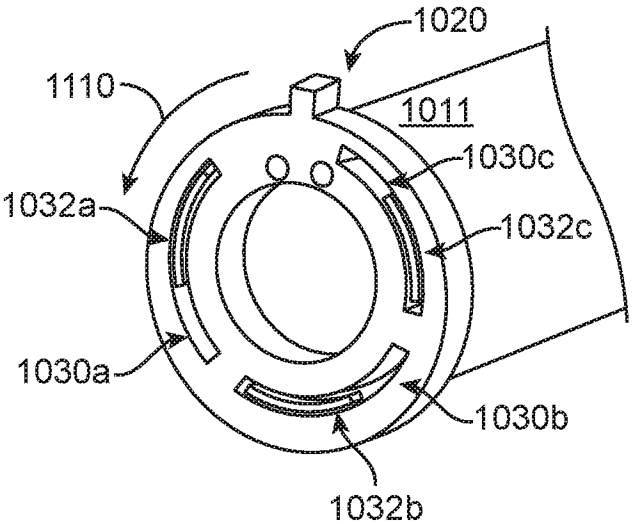
FIG. 11 is a diagram of an alignment fixture once inserted onto a charge tube and then twisted into a locking position, according to an embodiment of the disclosure.
Figure 10:
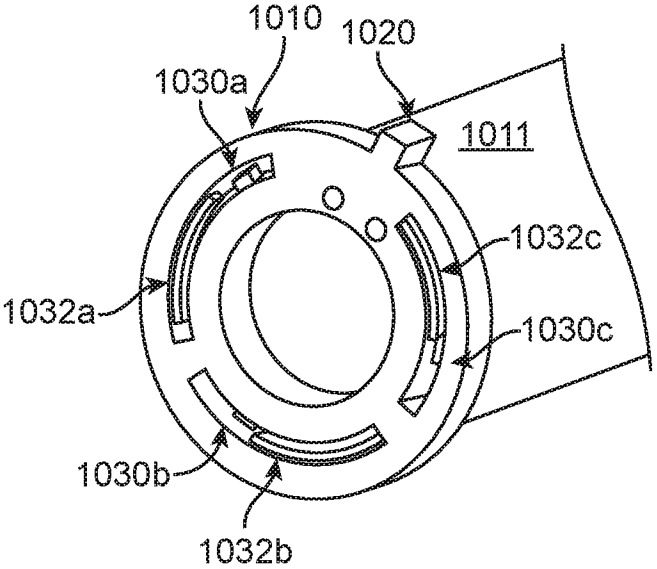
FIG. 10 is a diagram of an alignment fixture inserted into a charge tube, according to an embodiment of the disclosure.
Figure 12:
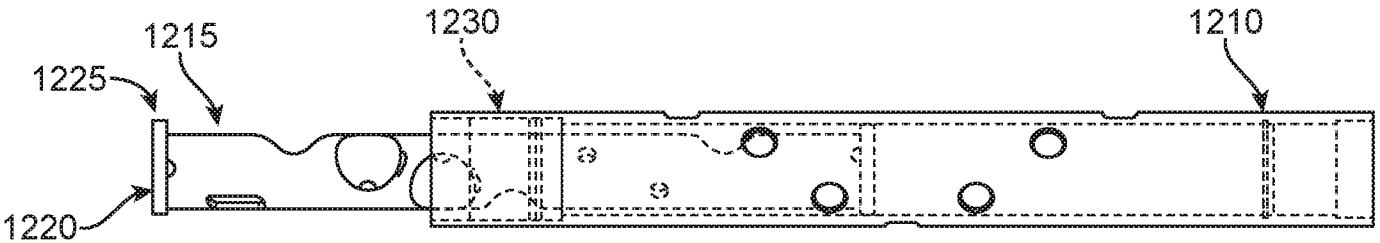
FIG. 12 is a diagram of a charge tube with an alignment fixture secured thereto as it is partially inserted within a gun body, as viewed from the side, according to an embodiment of the disclosure.

Referring to FIG. 8, the alignment fixture 610 is now engaged with the charge tube 710 in a first "connected" state, according to an embodiment of the disclosure. Note that the ends of the protrusions 720 each extend longitudinally outward past the end of the alignment fixture 610 in this embodiment. In other embodiments, for example as shown in FIGS. 10-12, the protrusions on the ends of the charge tube are flush with the end of the alignment fixture when engaged. The protrusions may also lie longitudinally inward so as to no extend past the ends of the alignment fixture in some applications.

Figure 9:
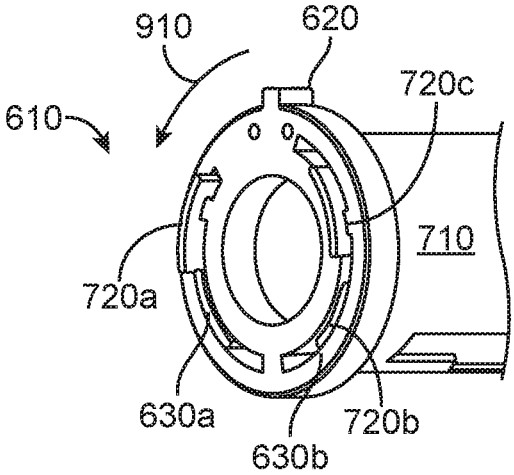
FIG. 9 is a diagram of an alignment fixture engaged with a charge tube in a second "locked" state, according to an embodiment of the disclosure.

Now turning to FIG. 9, the alignment fixture 610 is engaged with the charge tube 710 in a second "locked" state, according to an embodiment of the disclosure. Note that the alignment fixture has been rotated counter-clockwise (in the direction of arrow 910) to lock the alignment fixture into place. The protrusions on the charge tube 710 are fully engaged with the slots of the alignment fixture.

Reference is now made to FIGS. 10-12 showing an embodiment of alignment fixture and charge tube where ends of charge tube protrusions are flush with an end of an alignment fixture when engaged. FIG. 12 shows the charge tube and self-locking alignment fixture as partially inserted within the gun body.

An alignment fixture 1010 is inserted onto a charge tube 1011. The alignment fixture 1010 includes an alignment finger 1020 for engaging a groove in a gun body of a perforation tool assembly (see groove 1230, for example, in FIG. 12). The alignment fixture 1010 includes a plurality of openings or slots 1030*a*, 1030*b*, and 1030*c* (collectively alignment openings "1030"). The charge tube 1011 includes a plurality of protrusions 1032*a*, 1032*b* and 1032*c* (collectively charge tube protrusions "1032"), which respectively engage the openings 1030*a*, 1030*b* and 1030*c*. The alignment fixture is twisted counter-clockwise (in the direction of arrow 1110 in FIG. 11) to lock the charge tube protrusions 1032 into place. As shown in FIG. 12, a charge tube 1215 with attached alignment fixture 1225 is inserted into a gun body 1210. An alignment fixture 1220 includes alignment finger 1225 that engages a slot 1230 on the gun body 1210. The charge tube and alignment fixture are slid into the gun body and end caps are installed in accordance with ordinary skill.

Figure 13:
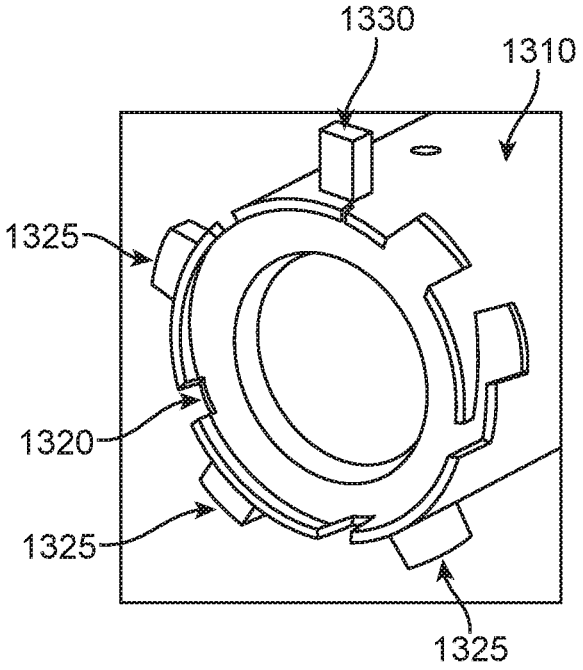
FIG. 13 is a diagram of an alignment fixture with integrated alignment finger, as alignment fixture is secured to a charge tube, according to another embodiment of the disclosure.
Figure 14:
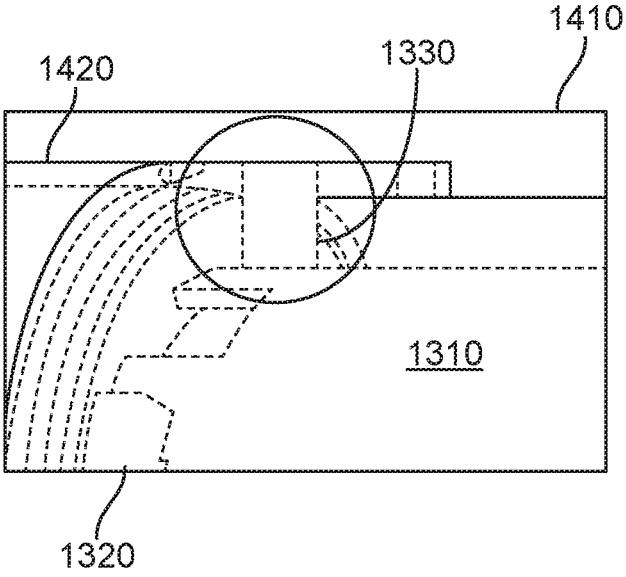
FIG. 14 is a diagram of the alignment fixture with integrated alignment finger secured to the charge tube and the alignment finger engaging an interior surface of the gun body, according to the other embodiment of the disclosure.

Reference is now made to FIGS. 13 and 14 showing is a diagram of an alignment fixture with integrated alignment finger, as alignment fixture is secured to a charge tube, according to an embodiment of the disclosure.

A charge tube 1310 engages with an alignment fixture 1320 to align the charge tube at an appropriate location within a gun body. The alignment fixture 1320 has a plurality of protrusions 1325 that create openings in the alignment FIG. 1230 that engage protrusions on an end of the charge tube 1310. An alignment finger 1330 integrated on the alignment fixture 1320 is for engaging a slot (for example slot 1420 in FIG. 14) on an interior surface of a gun body. As shown in FIG. 14, a gun body 1410 includes a slot 1420 that receives the alignment finger 1330 of the alignment fixture 1320 for aligning the charge tube 1310 with respect to the gun body 1410.

The alignment fixture in accordance with the disclosures herein provides for centralizing the charge tube within the gun body. The alignment fixture can further include an alignment finger in any embodiment that aligns the charge tube, and more importantly the charges contained therein, with respect to a desired position along the gun body, for example, at a proper location with respect to scallops on an exterior surface of the gun body.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that one member of the set or multiple members of the set satisfy the claim.

We claim:

1. A perforation tool assembly comprising:

a first alignment fixture and a second alignment fixture, each alignment fixture having a plurality of slots and at least one alignment finger on the circumferential outer edge of the alignment fixture;

a self-locking charge tube having a plurality of protrusions on each of a first end and a second end of the self-locking charge tube, each of the plurality of protrusions extend vertically from and laterally over a cut out, and a plurality of displaceable flanges where one of the plurality of displaceable flanges is located at the base of each cut out, the plurality of protrusions rotatably engageable with the plurality of slots on each of the first alignment fixture and the second alignment fixture such that each of the plurality of displaceable flanges are displaced as the first alignment fixture and the second alignment fixture are rotated on the self-locking charge tube and return to their original position to lock the first and second alignment fixtures to the self-locking charge tube; and a gun body having a plurality of scallops and a milled slot on an interior surface of an end of the gun body, wherein when the self-locking charge tube is disposed within the gun body the alignment finger on at least one of the first alignment fixture or the second alignment fixture is engageable with the milled slot of the gun body, and each of a plurality of openings located along the length of the self-locking charge tube aligns with each of the plurality of scallops of the gun body.

2. The perforation tool assembly of claim 1 wherein the plurality of protrusions on at least one end of the self-locking charge tube protrude outward from the plurality of slots of the corresponding alignment fixture when the self-locking charge tube is fully engaged with the alignment fixture.

3. The perforation tool assembly of claim 1 wherein the plurality of protrusions on at least one end of the self-locking charge tube have ends that are flush with an end of the corresponding alignment fixture when the self-locking charge tube is fully engaged with the alignment fixture.

4. The perforation tool assembly of claim 1 wherein each alignment fixture is formed of at least one of steel, a powdered metal, an Aluminum Alloy, a plastic material and a rubber material.

5. The perforation tool assembly of claim 1 wherein the plurality of slots on each alignment fixture are formed by cutting using a water-jet, machining, molding or casting the alignment fixture.

6. The perforation tool assembly of claim 1 further comprising a plurality of charges disposed within the self-locking charge tube when the alignment fixtures are secured onto the self-locking charge tube.

7. The perforation tool assembly of claim 1 wherein the plurality of slots comprises a first slot on each alignment fixture and a second slot on each alignment fixture and the plurality of protrusions on each end of the self-locking charge tube comprise a first protrusion that engages the first slot of each alignment fixture and a second protrusion that engages the second slot on each alignment fixture.

8. An apparatus comprising: a first alignment fixture, a second alignment fixture, and a self-locking charge tube, each alignment fixture having a plurality of slots operable to receive and rotatably engage with a plurality of cut outs on each of a first end and a second end of the self-locking charge tube, each of the plurality of cut outs having a plurality of protrusions extending vertically therefrom and laterally over the cut out and a plurality of displaceable flanges located at the base of each of the plurality of cut outs, wherein each of the plurality of displaceable flanges are displaced as the first alignment fixture and the second alignment fixture are rotated on the self-locking charge tube and return to their original position to lock each of the first alignment fixture and the second alignment fixture to the self-locking charge tube;

an alignment fmger on at least one of the alignment fixtures engages with an interior surface of a gun body when the self-locking charge tube is received in the gun body, the alignment finger aligning each of a plurality of openings along the length of the self-locking charge tube with each of a plurality of scallops on an exterior surface of the gun body.

9. The apparatus of claim 8 further comprising a plurality of charges disposed within the self-locking charge tube.

10. The apparatus of claim 9 wherein the alignment fmger further aligns each of the plurality of charges with each of the plurality of scallops.

11. The apparatus of claim 8 wherein each alignment fixture is formed of at least one of steel powdered metal, an Aluminum Alloy, a plastic material and a rubber material.

12. The apparatus of claim 8 wherein the alignment fmger engages a milled slot on the interior surface of the gun body.

13. The apparatus of claim 8 wherein the plurality of slots on each alignment fixture are formed by cutting using a water-jet, machining, molding or casting the alignment fixture.

14. A method of assembling part of a perforation tool assembly, the method comprising:

aligning a plurality of slots on a first alignment fixture and a second alignment fixture with a plurality of protrusions on each end of a self-locking charge tube, the self-locking charge tube being received within a gun body and further comprising a plurality of cut outs adjacent to and extending below each of the plurality of protrusions;

placing the first alignment fixture and the second alignment fixture onto each end of the self-locking charge tube so that the plurality of protrusions on each end of the self-locking charge tube are inserted into the plurality of slots on each alignment fixture such that each of the first alignment fixture and the second alignment fixture are resting in a plurality of cut outs; and rotating each alignment fixture until the alignment fixtures lock on to the self-locking charge tube wherein a plurality of displaceable flanges located at the base of each of the plurality of cut outs are displaced as the first alignment fixture and the second alignment fixture rotate and return to their original position to lock each alignment fixture onto the self-locking charge tube, and wherein when the alignment fixtures are locked into place each of a plurality of openings along the length of the self-locking charge tube align with each of a plurality of scallops on an exterior surface of the gun body.

15. The method of claim 14 further comprising inserting the self-locking charge tube into the gun body.

16. The method of claim 15 further comprising aligning an alignment finger on at least one alignment fixture with an alignment slot on an interior surface of the gun body when inserting the self-locking charge tube into the gun body.

* * * * *